US009521879B2

(12) United States Patent
Leach

(10) Patent No.: US 9,521,879 B2
(45) Date of Patent: Dec. 20, 2016

(54) REMOVABLE STUD OR CLEAT ASSEMBLY FOR FOOTWEAR

(75) Inventor: Craig Leach, Gilston (AU)

(73) Assignee: RAPTOR SPORTS PTY LTD, Gilston (AU)

( * ) Notice: Subject to any disclaimer, the term of this patent is extended or adjusted under 35 U.S.C. 154(b) by 256 days.

(21) Appl. No.: 14/118,097

(22) PCT Filed: May 15, 2012

(86) PCT No.: PCT/AU2012/000536

§ 371 (c)(1),
(2), (4) Date: Nov. 15, 2013

(87) PCT Pub. No.: WO2012/155198

PCT Pub. Date: Nov. 22, 2012

(65) Prior Publication Data

US 2015/0305446 A1 Oct. 29, 2015

(30) Foreign Application Priority Data

May 17, 2011 (AU) ..... 2011901895

(51) Int. Cl.
*A43C 15/16* (2006.01)

(52) U.S. Cl.
CPC ..... *A43C 15/161* (2013.01); *A43C 15/168* (2013.01)

(58) Field of Classification Search
CPC ..... A43C 15/161; A43C 15/02; A43C 15/14; A43C 15/16; A43C 15/162; A43B 5/001; A43B 5/002; A43B 5/02; A43B 13/22; A43B 13/26; A43B 13/28
USPC . 36/66, 62, 65, 127, 128, 134, 126, 129, 61
See application file for complete search history.

(56) References Cited

U.S. PATENT DOCUMENTS

| | | | |
|---|---|---|---|
| 4,445,288 | A | 5/1984 | Froer |
| 5,025,576 | A | 6/1991 | Biasiotto et al. |
| 5,628,129 | A | 5/1997 | Kilgore et al. |
| 5,875,572 | A | 3/1999 | Redburn |

(Continued)

FOREIGN PATENT DOCUMENTS

| | | |
|---|---|---|
| DE | 3342397 | 6/1985 |
| EP | 0360202 | 3/1990 |

(Continued)

*Primary Examiner* — Anna Kinsaul
*Assistant Examiner* — Heather Mangine
(74) *Attorney, Agent, or Firm* — Greer, Burns & Crain, Ltd.

(57) ABSTRACT

A removable stud or cleat assembly for footwear is provided, particularly for athletic or sports footwear. The stud or cleat assembly includes a stud having a first and second mounting structure and engagement structure located on the sole of the footwear and configured for engaging the first and second mounting structure of the stud. Engagement of the stud is achieved by aligning the first mounting structure relative to the engagement structure, temporarily deforming the second mounting structure and rotating the stud relative to the engagement structure to thereby securely engage the first and second mounting structure with the engagement structure. Disengagement of the stud from the engagement structure is achieved by biasing the second mounting structure to disengage the second mounting structure from the engagement structure and rotating the stud relative to the engagement structure to thereby disengage the first mounting structure.

12 Claims, 5 Drawing Sheets

(56) References Cited

U.S. PATENT DOCUMENTS

| | | | | |
|---|---|---|---|---|
| 6,050,006 | A | 4/2000 | Swindle | |
| 6,115,947 | A | 9/2000 | Swindle | |
| 6,302,617 | B1 | 10/2001 | Rumpp | |
| 7,007,413 | B2 | 3/2006 | McMullin | |
| 7,076,894 | B2 | 7/2006 | Santos et al. | |
| 7,137,213 | B2 | 11/2006 | Kelly et al. | |
| 7,147,399 | B2 | 12/2006 | Viscount et al. | |
| 7,249,428 | B1 | 7/2007 | Burella | |
| 2002/0056210 | A1 | 5/2002 | Kelly et al. | |
| 2005/0000119 | A1 | 1/2005 | McMullin | |
| 2007/0092333 | A1 | 4/2007 | Viscount et al. | |
| 2007/0209239 | A1* | 9/2007 | Kelly | A43C 15/161 36/127 |
| 2009/0307933 | A1* | 12/2009 | Leach | A43C 15/168 36/134 |
| 2010/0257751 | A1 | 10/2010 | Burt et al. | |

FOREIGN PATENT DOCUMENTS

| | | |
|---|---|---|
| WO | 86/06592 | 11/1986 |
| WO | 2009/060841 | 5/2009 |

* cited by examiner

REMOVABLE STUD OR CLEAT ASSEMBLY FOR FOOTWEAR

TECHNICAL FIELD

The present invention concerns a removable stud or cleat for footwear, particularly for athletic or sports footwear.

BACKGROUND

The reference to any prior art in this specification is not, and should not be taken as an acknowledgement or any form of suggestion that the prior art forms part of the common general knowledge.

Many types of footwear, particularly athletic footwear, are fitted with studs, spikes or cleats in order that the wearer may maintain their footing, even when the ground is wet and slippery. This type of footwear is commonly used by golfers, cricketers, athletes and players of all football codes.

Traditionally, the studs, spikes or cleats (hereafter collectively referred to as "studs") have been of the type that comprises a screw thread for screwing the stud into a threaded bore in the sole of a shoe. The studs once threaded into the sole of a shoe typically require a tool to tighten or loosen the studs for attachment or removal from the sole. Furthermore, in order to accommodate the threaded bore, the sole of the shoe must be quite thick. In turn, a thick sole makes the shoe heavy, less flexible, and therefore less comfortable for the wearer. Additionally, on hard playing surfaces the screw threads of the studs and the threaded bores in the shoes can apply significant pressure on the delicate metatarsal bones in the feet of a wearer making the shoes very uncomfortable.

Furthermore, another disadvantage with traditional studs is that they are typically formed from a rigid material and as such are often responsible for many potentially career ending lower leg injuries where the studs get caught on the playing surface while the wearer's ankle rolls or knee twists.

There is also an advantage to provide a stud that can be replaced, and especially a stud that can be replaced in a relatively easy manner. This is particularly important for athletes and players of all football codes who have to routinely replace studs due to wear, weather conditions or for safety reasons.

Some attempts have been made to overcome these issues. For instance, in international patent application no. PCT/AU2010/000039 (the contents of which are hereby incorporated by reference) a removable spike or cleat having multiple ground-engaging legs is disengaged from a shoe by deforming the ground-engaging legs. While this is suitable when multiple ground-engaging legs are present (for instance, in spikes for golf shoes), this will not always be the case. For instance, some studs for various codes of football, cricket and athletics comprise only a single ground-engaging portion. This ground-engaging portion may be rigid and non-deformable or alternatively may be resiliently deformable.

Thus, there is a need for an alternative removable stud assembly for footwear.

SUMMARY

It is an object of the present invention to provide a removable stud assembly for footwear which may overcome at least some of the abovementioned disadvantages, or provide a useful or commercial choice.

According to an aspect of the present invention, there is provided a removable stud assembly for footwear, the assembly including:

a stud having first and second mounting means, at least one of the first and second mounting means being at least partially formed from a resilient deformable material; and engagement means located on a sole of the footwear and adapted to engage the first and second mounting means of the stud, wherein engagement of the stud with the engagement means is achieved by aligning the first mounting means relative to the engagement means, temporarily deforming the second mounting means and rotating the stud relative to the engagement means to thereby securely engage the first and second mounting means with the engagement means, and wherein disengagement of the stud from the engagement means is achieved by biasing the second mounting means to disengage the second mounting means from the engagement means and rotating the stud relative to the engagement means to thereby disengage the first mounting means.

In another aspect of the present invention, there is provided a removable stud assembly for footwear, the assembly including:

a stud having first and second mounting means, at least one of the first and second mounting means being at least partially formed from a resilient deformable material, the second mounting means being naturally biased into an engaged condition; and engagement means located on a sole of the footwear and adapted to engage the first and second mounting means such that, once engaged, the stud is substantially precluded from rotation relative to the engagement means, wherein disengagement of the stud is achieved by moving the second mounting means between the engaged condition and a disengaged condition against the natural bias of the second mounting means and rotating the stud relative to the engagement means.

In an embodiment of the present invention, a stud assembly for footwear is provided that allows studs to be fitted to footwear in a relatively easy manner without the use of a tool to attach and remove the studs. The studs do not require a screw thread and therefore the sole of the corresponding footwear does not need to have a thick sole to accommodate a threaded bore. Thus, the footwear can have a relatively thin sole. The absence of a screw thread and a corresponding threaded bore reduces any discomfort to a wearer particularly on a hard playing surface. Furthermore, potentially career ending injuries may be reduced by at least partially forming the studs from a resiliently deformable material.

The stud assembly may be of any suitable size, shape and construction and may be formed from any suitable material or materials. The stud assembly may be constructed from lightweight and strong materials such as plastic, fibreglass or a light metal such as aluminium. By constructing the stud assembly from lightweight materials, the assembly does not add a great deal of weight to the footwear, making the footwear more comfortable for the wearer.

The stud may be of any suitable size, shape and construction and may be formed from any suitable materials or materials. Preferably, the stud will be partially formed from material that is resiliently deformable. Any part of the stud may be formed from a resiliently deformable material. Typically, however, the ground engaging portion of the stud may be formed from a resilient deformable material such as rubber or soft plastic. The footwear engaging portion of the stud will preferably be formed from a rigid material. Typically, the footwear engaging portion of the stud may be formed from plastic or metal. By constructing the ground engaging portion of the stud from a resilient deformable material, the ground engaging portion provides a cushioning effect against the impact of the footwear against the ground thereby providing the wearer with greater comfort. Additionally, the construction of the ground engaging portion from a resilient deformable material results in a safer stud with a ground engaging portion which is less prone to become burred.

As previously described, the stud includes a first and second mounting means for engaging with the engagement means located on the sole of the footwear. The first and second mounting means may be of any suitable size, form and construction.

The first mounting means may be of any size, shape and construction suitably adapted to engage with corresponding engagement means located on the sole of the footwear. The first mounting means may include one or more engagement portions projecting from the footwear engaging portion of the stud. The engagement portions may be of any suitable size, number, shape or configuration. The engagement portions may comprise a pair of land or tab portions extending from an outer periphery of the footwear engaging portion. Additionally, the engagement portions may further comprise an aperture defined by the footwear engaging portion of the stud with the pair of land or tab portions extending from the outer periphery of the footwear engaging portion of the stud into the aperture. The aperture may be adapted to at least partially receive and engage with a complementary-shaped projection provided on the engagement means. The pair of land or tab portions may be adapted to prevent translational or lateral disengagement of the complementary-shaped projection from the aperture, once the stud is firmly secured to the engagement means on the sole of the footwear.

Preferably, the pair of land or tab portions are inwardly extending projections that partially extend around the edge of the aperture.

In a preferred embodiment, the first mounting means includes at least two inwardly extending projections and an aperture with the at least two inwardly extending projections partially extending around the peripheral edge of the aperture.

The at least two inwardly extending projections may be spaced apart from one another around the peripheral edge at any suitable distance. Preferably, however, the at least two inwardly extending projections are spaced substantially equidistantly from one another around the peripheral edge.

The at least two inwardly extending projections may be of any suitable size, shape, or configuration but will preferably of sufficient size to engage with the engagement means in a manner that prevents accidental or unwanted disengagement of the stud from the engagement means on the sole of the footwear.

The second mounting means may be of any size, shape and construction suitably adapted to engage with corresponding engagement means located on the sole of the footwear. The second mounting means may include one or more leg members. The second mounting means may be adapted to prevent rotation of the stud relative to the sole of the footwear, once the stud is firmly secured to the sole of the footwear.

Preferably, the second mounting means are positioned radially outwardly from the first mounting means. The second mounting means preferably extend substantially parallel to the longitudinal axis of the stud when biased into the engaged condition.

Preferably, the leg members comprise elongate members adapted to engage with corresponding portions of the engagement means.

In a preferred embodiment, the second mounting means comprises at least two leg members located substantially opposite one another on the periphery of the footwear engaging portion of the stud. The at least two leg members may be of any suitable size, shape and configuration but will preferably be of sufficient size and shape to engage with the corresponding portions of the engagement means to prevent accidental or unwanted rotational disengagement of the stud from the engagement means on the sole of the footwear.

The first and second mounting means may be arranged in any suitable configuration on the footwear engaging portion of the stud such that the first and second mounting means may suitably engage with the engagement means. Preferably, the first mounting means is located in central portion of the footwear engaging portion of the stud with the second mounting means is arranged around a peripheral portion of the footwear engaging portion of the stud.

In a preferred embodiment, the inwardly extending projections of the first mounting means and the one or more leg members of the second mounting means are located on adjacent sides of the aperture of the first mounting means.

The engagement means may be of any suitable form, shape and construction to receive and engage with the first and second mounting means of the stud. In a preferred embodiment however, the engagement means comprises a base portion adapted for attachment to the footwear, and particularly the sole of the footwear, a first retention means adapted to engage with the first mounting means and a second retention means adapted to engage with the second mounting means.

The base portion of the engagement means may be formed separately and adapted for engagement with the sole of the footwear, or the base portion may be integrally formed with the sole of the footwear.

The first retention means may be of any size, shape and construction suitably adapted to engage with the first mounting means. The first retention means may comprise one or more projections extending from the base portion.

The second retention means may be of any size, shape and construction suitably adapted to engage with the second mounting means. The second retention means may comprise one or more collared portions extending from the base portion and axially extending around each projection of the first retention means.

The projections of the first retention means may be of any suitable configuration, it is preferred however that each projection comprise a post with a retention portion located at or adjacent the end of the projection furthest from the base portion. The end portion preferably will have a barbell profile shape adapted to be received within the aperture of the first mounting means and engage with the pair of inwardly extending projections of the first mounting means. That is, the end portion has a profile shape that has narrow a central portion where the end portion is attached to the post and two opposed lateral extensions. The engagement of the first mounting means with the first retention means prevents translational and lateral movement of the stud relative to the engagement means.

Preferably, each projection corresponds to a single stud.

The one or more collared portions of the second retention means may extend from the base portion and axially extending partially around each projection and may be of any suitable size, shape and construction. The partial extension of the one or more collared portions around each projection may define one or more gap regions adapted to receive and engage with the one or more leg members of the second mounting means.

The one or more collared portions may be elongate members and may have a fixed width and length but a variable height gradient from one longitudinal end of a collared portion to the other, such that the collared portion effectively takes the shape of a ramp.

In a preferred embodiment, the second retention means may comprise two opposed collared portions extending from the base portion and axially extending partially around each projection. Typically, the two collared portions may define two gap regions between the longitudinal ends of one collared portion relative to the respective ends of the other collared portion. The gap regions are preferably adapted to receive and engage with the two leg members of the second mounting means. The engagement of the second mounting means with the second retention means prevents rotational movement of the stud relative to the engagement means.

The first and second retention means may be arranged in any suitable configuration relative to one another such that the first and second mounting means may be suitably engaged. In a preferred embodiment however, the two collared portions of the second retention means extend partially around the projection of the first retention means and are located 90 degrees relative to the two opposed lateral extensions of the end portion of the projection of the first retention means. That is, the two gap regions are radially aligned relative to the two opposed lateral extensions.

The engagement between the first mounting means in the first retention means and between the second mounting means and the second retention means may be achieved using any suitable technique. For instance, the first mounting means including the aperture and/or the one or more inwardly extending projections, or the first retention means including the post and/or the end portion may be provided with lands, recesses, projections, sticky, tacky or implicit portions, hook and loop fasteners or the like, or any combination thereof to facilitate in the engagement between the first mounting means and the first retention means or likewise between the second mounting means and the second retention means.

Preferably, each stud may be fabricated in such a way that the one or more leg members of the second mounting means have a natural bias into the engaged condition. In this way, the natural bias of the one or more leg members may result in the one or more leg members engaging with the one or more collared portions and the one or more gap regions of the second retention means with sufficient force to retain the stud in place on the engagement means, once the first mounting means and first retention means are securely engaged.

By partially fabricating the stud from a resilient deformable material, the stud may be at least partially deformed during attachment/engagement or removal/disengagement from the engagement means on the sole of the footwear. The ability to manually deform the stud makes its removal or attachment simple, fast and does not require the wearer to remove the footwear to clean or replace a stud. Specifically, the one or more leg members of the second mounting means of the stud may be temporarily deformed through the application of pressure. The application of pressure to the stud against the engagement means on the sole footwear may cause the one or more leg members of the second mounting means to be temporarily deformed outwards and away from the first mounting means, thereby either engaging the second retention means or overcoming the natural bias of the one or more leg members to disengage from the second mounting means. When the one or more leg members are temporarily deformed, the stud may then be rotated out of engagement with the engagement means, thereby disengaging the first mounting means from the first retention means and allowing the stud to be lifted clear from the engagement means.

In order to make the application of manual pressure to the stud easier for the user, the stud may further comprise one or more pressure points adapted for a user's fingers or a tool. The stud may comprise handle portions adapted for manipulation by a user's fingers. Alternatively, the stud may comprise a receiving portion adapted to receive a tool, which in turn may be used to apply manual pressure to the stud. Specifically, the one or more pressure points may comprise one or more outwardly extending projections located around the peripheral edge of the stud. The outwardly extending projections will preferably be accessible even while the stud is firmly attached to the sole of the footwear.

The location of the engagement means on the sole of the footwear is not critical. However, the engagement means will typically be placed in positions on the sole of the footwear that provide the user with the best comfort and grip. Similarly, the number of engagement means (and therefore the number of removable stud assemblies) is not critical, although a skilled addressee will understand that the number of engagement means will be determined by a desire to provide the user with the best comfort and grip. However, a skilled addressee will also understand that the number of engagement means will be limited to the size of the footwear (i.e. large footwear may be provided with more engagement means). It is envisaged, however, the size of, the removable stud assemblies could be varied depending on the wearer (for instance, relatively large assemblies in men's footwear, and smaller assemblies in women's and children's footwear).

In some embodiments of the invention, the stud may be provided with indicia adapted to assist a user to engage/disengage the stud from the engagement means. Any suitable indicia may be used, such as, but not limited to, symbols (such as arrows), letter, numbers, pictures or the like, or any combination thereof. Preferably, the indicia indicate the direction in which the stud may be rotated in order to engage/disengage the stud with/from the engagement means.

In a further aspect of the present invention, there is provided footwear comprising at least one removable stud assembly as hereinbefore described.

The sole of the footwear may be manufactured using any suitable process.

However, it is preferred that the sole of the footwear is moulded from plastic, rubber or other like substance. In a preferred embodiment of the invention, the sole of the footwear is formed in two parts. The first part, or skeleton, may be formed of any hard material, such as, but not limited to, polyurethane, while the second part may be formed of a softer material. Typically, the skeleton will be at least partially surrounded by the second part. In use, the skeleton may comprise one or more of the engagement means integrally formed within it.

The sole of the footwear may include indicia which correspond with indicia provided on the stud to assist a user in aligning the stud relative to the engagement means. Any suitable indicia may be used, such as those described hereinbefore.

In another aspect, the invention resides broadly in a mounting assembly, the assembly including:

a mounting portion having first and second mounting means, at least one of the first and second mounting means being at least partially formed from a resilient deformable material; and engagement means located on a surface and adapted to engage the first and second mounting means of the mounting portion, wherein engagement of the mounting portion with the engagement means is achieved by aligning the first mounting means relative to the engagement means, temporarily deforming the second mounting means and rotating the mounting portion relative to the engagement means to thereby securely engage the first and second mounting means with the engagement means, and wherein disengagement of the mounting portion from the engagement means is achieved by biasing the second mounting means to disengage the second mounting means from the engagement means and rotating the mounting portion relative to the engagement means to thereby disengage the first mounting means.

A skilled addressee will understand that the mounting assembly may be used for any suitable purpose. For instance, the mounting assembly may be used in the mining, construction (building, vehicle manufacture, maritime etc), medical or agricultural industries, in order to connect two elements together. However, it is envisaged that the mounting assembly may be used for any suitable purpose in any suitable industry or application.

The elements that may be connected together using the mounting assembly may be of any suitable form. For instance, the elements may comprise structural elements (beams, brackets, supports, panels or the like, or a combination thereof). Alternatively, the elements may comprise posts, rails, braces or the like (such as for fencing). Still further, the elements may comprise artificial joints, such as for medical use or the like.

Alternatively, the mounting assembly may be used as a fastening device, such as to be used in the place of nuts and bolts, screws, nails, rivets or the like.

BRIEF DESCRIPTION OF THE DRAWINGS

Preferred features, embodiments and variations of the invention may be discerned from the following Detailed Description which provides sufficient information for a skilled addressee to perform the invention. The Detailed Description is not to be regarded as limiting the scope of the preceding Summary Of The Invention in an way. The detailed description will make reference to a number of drawings as follows.

DETAILED DESCRIPTION

According to an embodiment of the present invention, there is provided a removable stud assembly for footwear as shown in FIGS. 1 to 5. The assembly includes a stud 2 at least partially formed from resilient deformable material and having first and second mounting means 4, 6. The assembly includes engagement means 8 adapted to be located on a sole of the footwear and adapted to engage the first and second mounting means 4, 6. Engagement of the stud 2 with the engagement means 8 is achieved by aligning the first mounting means 4 relative to the engagement means 8, temporarily deforming the second mounting means 6, and rotating the stud 2 relative to the engagement means 8 to thereby securely engage the first and second mounting means 4, 6 with the engagement means 8. Disengagement of the stud 2 from the engagement means 8 is achieved by biasing the second mounting means 6 to disengage the second mounting means 6 from the engagement means 8 and then rotating the stud 2 relative to the engagement means 8 to thereby disengage the first mounting means 4.

Figure 1:
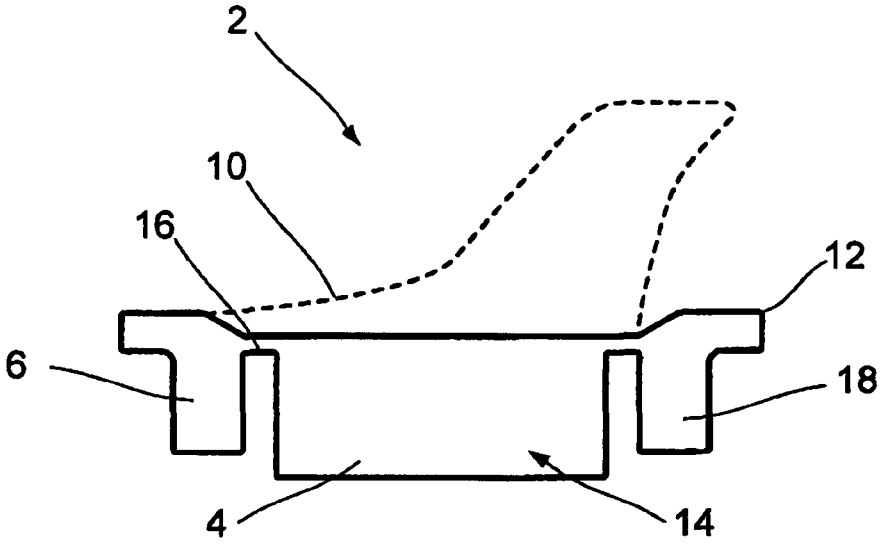
FIG. 1 is a side view of a stud in accordance with an embodiment of the present invention.

As shown in FIG. 1, the stud 2 has a ground engaging portion 10 that is formed from material that is resiliently deformable such as rubber or plastic. The ground engaging portion 10 may have any suitable size, shape or configuration that provides the user with the best comfort and grip. The stud 2 has two opposed handles 12 (i.e. outwardly extending projections) located at the peripheral edge of the stud 2 to facilitate in the application of pressure to engage/disengage the stud 2 from the engagement means 8.

The footwear engaging portion 14 of the stud 2 includes the first mounting means 4 and the second mounting means 6, and is formed from a rigid material such as plastic or metal.

The temporary deformation of the second mounting means 6 is facilitated by the thinness of the rigid material at pivot point 16 of the footwear engaging portion 14 of the stud 2 connecting the first mounting means 4 with the second mounting means 6. The application of pressure to the stud 2 to engage/disengage the stud 2 with/from the engagement means 8 results in the temporary deformation of the second mounting means 6 via the pivoting of the second mounting means 6 at pivot point 16 outwards and away from the first mounting means 4.

The second mounting means 6 includes two opposed locking lugs 18 (i.e. leg members) that extend perpendicularly from the face of the footwear engaging portion 14 of the stud 2.

Figure 2:
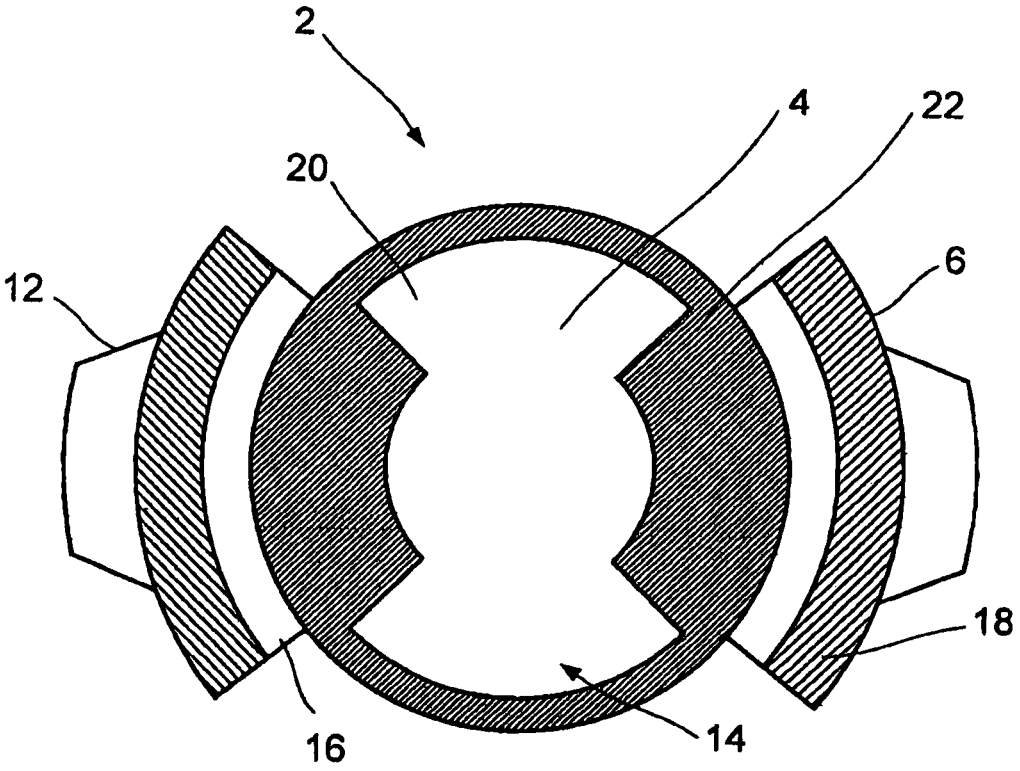
FIG. 2 is a top view of the stud of FIG. 1.

Referring to FIG. 2, a top view of the footwear engaging portion 14 of the stud 2 shows that the first mounting means 4 includes an aperture 20 and two opposed lugs 22 (i.e. inwardly extending projections). Additionally, the two opposed lugs 22, the two opposed locking lugs 18 and the two opposed handles 12 are all radially aligned with one another to facilitate engagement between the first mounting and second mounting means 4, 6 with the engagement means 8.

Figure 3:
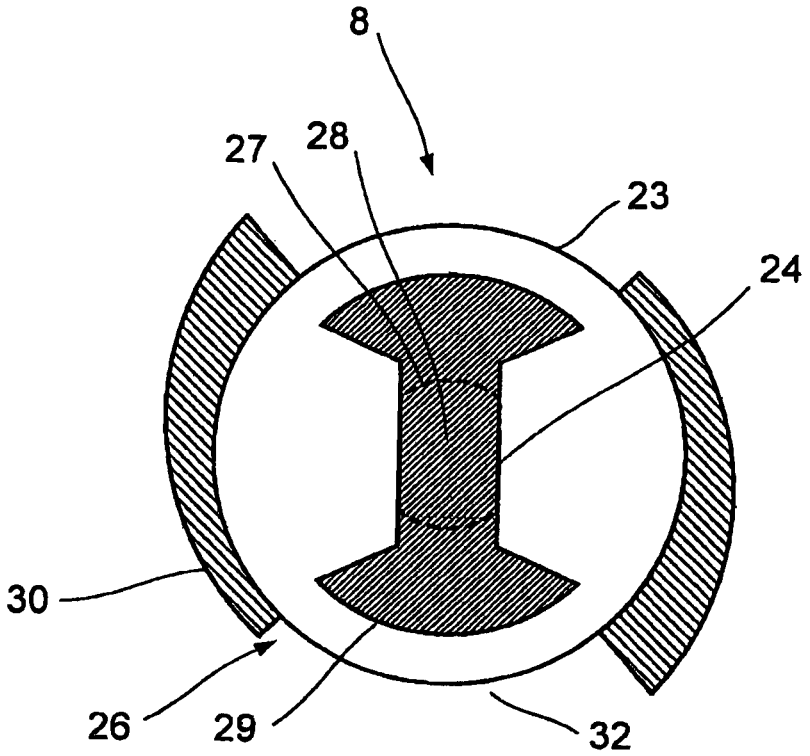
FIG. 3 is a sectional view of engagement means adapted to be located on the sole of footwear and to receive and engage the stud of FIG. 1.

FIG. 3 shows a top view of the engagement means 8. The engagement means 8 includes a base portion 23, a first retention means 24 and a second retention means 26 adapted to receive and engage respectively with the first and second mounting means 4, 6. The first retention means 24 includes a post 27 and an end portion 28 adapted to be received within the aperture 20 of the first mounting means 4. The end portion 28 includes two opposed horizontal lugs 29 (i.e. opposed lateral extensions) that are adapted to engage with the two opposed lugs 22 of the first mounting means 4. The second retention means 26 includes two opposed collared portions 30, each including an elongate member, that extend from the base portion 23 and extend partially around a portion of a periphery of the two opposed horizontal lugs 29 of the first retention means 24 to define a first portion of the periphery, and two opposed locking lug areas 32 (i.e. two gap regions) defined between adjacent collared portions 30 or between the first portion and a remainder of the periphery of the two opposed horizontal lugs 29 of the first retention means 24, and adapted to receive and engage the two opposed locking lugs 18 of the second mounting means 6.

To facilitate the engagement of the first retention means 24 with the first mounting means 4, wherein the two opposed lugs 22 of the first mounting means 4 are received beneath the opposed horizontal lugs 29 of the first retention means 24, the two opposed locking lug areas 32 are radially aligned with the horizontal lugs 29. This arrangement ensures that when the stud is rotated to engage the opposed lugs 22 of the first mounting means 4 beneath and with the horizontal lugs 29 of the first retention means 24, the natural bias of the two opposed locking lugs 18 of the second mounting means 6 will be biased over the two opposed collared portions 30 of the second retention means 26 into the respective opposed locking lug areas 32 of the second retention means 26 thereby firmly securing the stud 2 to the engagement means 8 and preventing translational, lateral and rotational movement of the stud 2 relevant to the engagement means 8.

Figure 4:
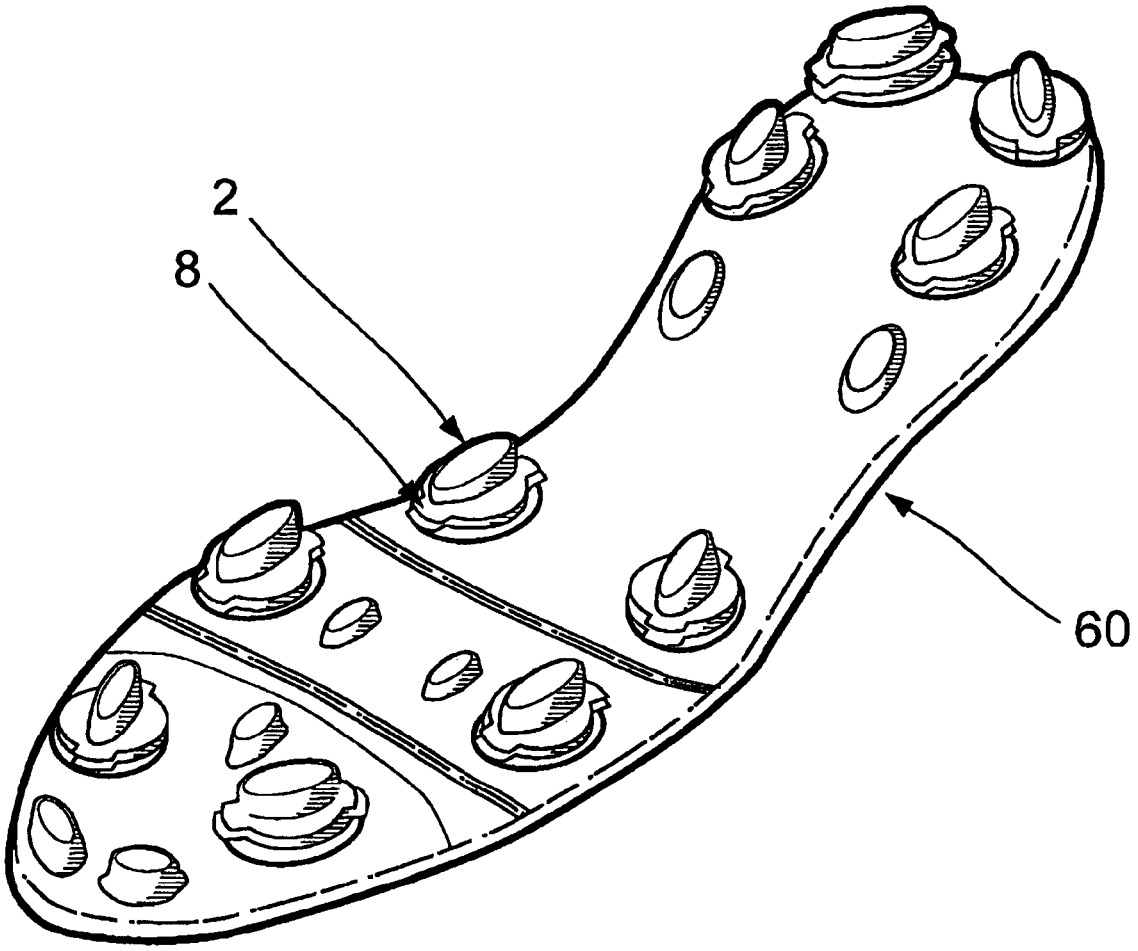
FIG. 4 is a perspective view of a stud assembly in accordance with an embodiment of the present invention.
Figure 5:
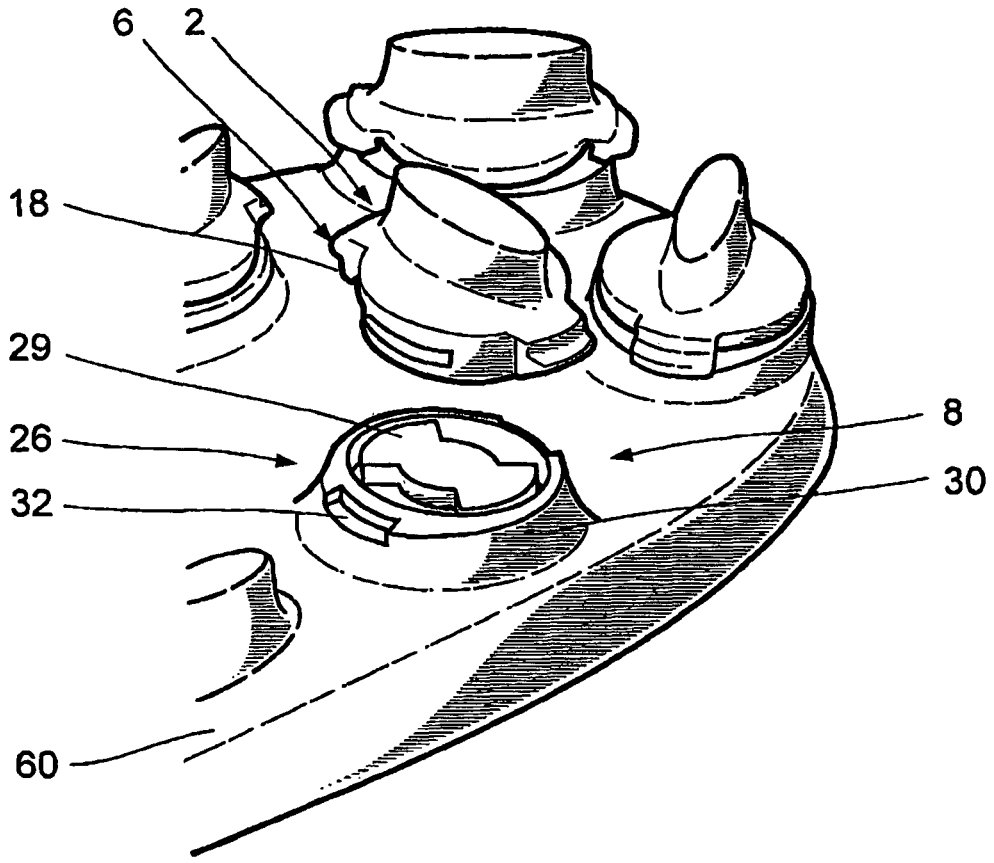
FIG. 5 is magnified view of the stud assembly of FIG. 4 in which a stud has been removed.

FIGS. 4 and 5 show perspective views of the removable stud assembly in accordance with another embodiment of the present invention in which the engagement means 8 is integrally formed with the sole 60 a shoe.

FIG. 4 shows a plurality of studs 2 engaged with corresponding engagement means 8 integrally formed with the sole 60 of the shoe.

FIG. 5 shows a stud 2 disengaged from the corresponding engagement means 8. A difference between this embodiment and the embodiment shown in FIGS. 1 to 3 is that the two opposed locking lug areas 32 of the second retention means 26 are not radially aligned with the horizontal lugs 29 of the first retention means 24, but instead the two opposed locking lug areas 32 are arranged at an angle of 90 degrees relative to the horizontal lugs 29. To accommodate this difference and maintain the same engagement principles, the two opposed lugs (obscured) of the first mounting means (obscured) of the corresponding stud 2 are arranged 90 degrees relative to the two opposed locking lugs 18 of the second mounting means 6. This ensures that when the stud 2 is rotated to engage the opposed lugs (obscured) of the first mounting means (obscured) beneath and with the horizontal lugs 29 of the first retention means 24, the natural bias of the two opposed locking lugs 18 of the second mounting means 6 will be biased over the two opposed collared portions 30 of the second retention means 26 into the respective opposed locking lug areas 32 of the second retention means 26

In use, with reference to FIGS. 2 and 3, a stud 2 of the present invention is attached to the engagement means 8 by aligning the stud 2 relative to the engagement means 8. The stud 8 is aligned such that the end portion 28 of the post 27 of the first retention means 24 can be inserted into the aperture 20 of the first mounting means 4. Once the end portion 28 is inserted, the stud 2 is partially deformed by pressing the stud 2 against the engagement means 8. The partial deformation of the stud 2 temporarily deforms the two opposed locking lugs 18 of the second mounting means 6 against their natural bias. The deformed locking lugs 18 move outwards and away from the first mounting means 4 and engage with the two collared portions 30 of the second retention means 26.

Whilst maintaining the locking lugs 18 in the temporarily deformed state, the stud 2 is rotated about 90 degrees relative to the engagement means 8. The rotation of the stud relative to the engagement means 8 aligns and engages the two horizontal lugs 29 of the end portion 28 of the first retention means 24 with the corresponding two lugs 22 of the first mounting means 4. The two lugs 22 of the first mounting means 4 lie between the base portion 23 of the engagement means 8 and the horizontal lugs 29 of the first retention means 24 thus preventing lateral and translational movement of the stud 2 relative to the engagement means 8.

The rotation of the stud 2 relative to the engagement means 8 also rotates the temporarily deformed locking lugs 18 away from the two collared portions 30. Once rotated clear of the two collared portions 30, the temporarily deformed locking lugs 18 driven by their natural bias return to a non-deformed state (i.e. the engaged condition) and are received in and engage with their respective locking lug areas 32. The engagement of the locking lugs 18 prevents further rotation of the stud 2 relative to the engagement means 8 and firmly secures the stud 2 to the engagement means 8.

A stud 2 can be disengaged and removed from the engagement means 8 by deforming the stud 2 by pulling the stud 2 via the handles 12 away from the engagement means 8. The deformation of the stud 2 temporarily deforms the locking lugs 18 and biases the locking lugs 18 from the engaged condition to disengage from the locking lug areas 32 allowing the rotation of the stud 2 relative to the engagement means 8.

Rotation of the stud 2 by about 90 degrees relative to engagement means 8 results in the disengagement of the two horizontal lugs 29 of the first retention means 24 from the two lugs 22 of the first mounting means 4. The rotation of the stud 2 aligns the horizontal lugs 29 with the aperture 20 and thereby allows the stud 2 to be lifted away from the engagement means 8.

A skilled addressee will appreciate that many embodiments and variations can be made without departing from the ambit of the present invention. For example, in another embodiment of the present invention, the second mounting means 6 of the stud 2 may comprise a single locking lug 18 that extends halfway around the circumference of the footwear engaging portion 14 of the stud 2. Likewise, the second retention means 26 of the engagement means 8 may include a single collared portion 30 that correspondingly extends axially halfway around the first retention means 24. Therefore, the single locking lug 18 would engage the single collared portion 30 and be received in a single locking lug area 32 that extends halfway around the first retention means 24.

In compliance with the statute, the invention has been described in language more or less specific to structural of methodical features. It is to be understood that the invention is not limited to specific features shown or described since the means herein described comprises preferred forms of putting the invention into effect.

Throughout the specification and claims, unless the context requires otherwise, the term "comprise", or variations such as "comprises" or "comprising", will be understood to apply the inclusion of the stated integer or groups of integers but not the exclusion of any other integer or group of integers.

The invention claimed is:

1. A removable stud assembly configured for use with footwear, the assembly comprising:

a stud at least partially formed from a resilient deformable material and having first and second mounting means; and engagement means adapted to be located on a sole of the footwear, the engagement means having a base portion configured for attachment to the sole of the footwear and first and second retention means configured to respectively engage the first and second mounting means of the stud, wherein the first mounting means comprises an aperture and at least two inwardly extending projections that partially extend around a peripheral edge of the aperture;

the second mounting means comprises one or more leg members;

the first retention means comprises a projection extending from the base portion with an end portion configured to be received in the aperture of the first mounting means and engage with the at least two inwardly extending projections; and the second retention means comprises one or more collared portions, each of said one or more collared portions comprises an elongate member extending outwardly from the base portion and extending partially around a portion of a periphery of the projection of the first retention means to define a first portion of the periphery, wherein one or more gap regions are defined between adjacent said collared portions or between the first portion and a remainder of the periphery of the projection of the first retention means, each of said one or more gap regions being configured to receive and engage with a leg member of said one or more leg members of the second mounting means, wherein to engage of the stud with the engagement means, the end portion of the projection of the first retention means is configured to be aligned and inserted into the aperture of the first mounting means and the one or more leg members of the second mounting means are configured to be temporarily deformable to allow the stud to be rotatable relative to the engagement means to securely engage the first and second mounting means of the stud with the first and second retention means of the engagement means, respectively, and wherein, when the stud is engaged with the engagement means, the one or more leg members of the second mounting means are configured to be temporarily deformable to disengage the second retention means from the second mounting means, and allow the stud to be rotatable relative to the engagement means to disengage the first mounting means of the stud from the first retention means of the engagement means.

2. The removable stud assembly of claim 1, wherein the at least two inwardly extending projections are spaced equidistantly around the aperture.

3. The removable stud assembly of claim 1, wherein the second mounting means comprises at least two leg members, the at least two leg members being located substantially opposite one another around a periphery of a footwear engaging portion of the stud.

4. The removable stud assembly of claim 1, wherein the base portion of the engagement means is configured to be integrally formed with the sole of the footwear.

5. The removable stud assembly of claim 1, wherein the second retention means comprises two opposed said collared portions to thereby define two said gap regions between the two opposed said collared portions.

6. The removable stud assembly of claim 5, wherein the end portion has a profile shape comprising a narrow central portion where the end portion is attached to the projection and two opposed lateral extensions, wherein the end portion is configured to be at least partially received within the aperture of the first mounting means and at least partially engage with the at least two inwardly extending projections of the first mounting means.

7. The removable stud assembly of claim 1, wherein the first mounting means is located in a central portion of a footwear engaging portion of the stud with the second mounting means arranged around a periphery of the footwear engaging portion of the stud.

8. The removable stud assembly of claim 1, wherein the at least two inwardly extending projections of the first mounting means and the one or more leg members of the second mounting means are located on adjacent sides of the aperture of the first mounting means.

9. The removable stud assembly of claim 6, wherein the two opposed said collared portions of the second retention means extend partially around the projection of the first retentions means and are located 90 degrees relative to the two opposed lateral extensions of the end portion of the projection of the first retention means.

10. The removable stud assembly of claim 9, wherein the two said gap regions are radially aligned relative to the two opposed lateral extensions of the end portion of the projection of the first retention means.

11. The removable stud assembly of claim 1, wherein the one or more leg members of the second mounting means are temporarily deformed through the application of pressure to the stud against the engagement means to cause the one or more leg members of the second mounting means to be temporarily deformed outwards and away from the first mounting means.

12. The removable stud assembly of claim 1, wherein when the one or more leg members are temporarily deformed, the stud can be rotated out of engagement with the engagement means, thereby disengaging the first mounting means from the first retention means and allowing the stud to be lifted clear from the engagement means.

* * * * *